United States Patent [19]

Hall

[11] 4,154,388

[45] May 15, 1979

[54] BOX CONSTRUCTION

[75] Inventor: Richard A. Hall, Pleasanton, Calif.

[73] Assignee: Willamette Industries, Inc., San Leandro, Calif.

[21] Appl. No.: 874,379

[22] Filed: Feb. 2, 1978

[51] Int. Cl.[2] ..... B65D 5/22; B65D 5/36

[52] U.S. Cl. ..... 229/16 R; 229/32

[58] Field of Search ..... 229/16 R, 32

[56] References Cited

U.S. PATENT DOCUMENTS

| | | | |
|---|---|---|---|
| 1,847,694 | 3/1932 | Komdolf | 229/32 |
| 2,885,137 | 5/1959 | Guyer | 229/32 X |
| 3,899,120 | 8/1975 | Fradkin | 229/32 |
| 3,905,540 | 9/1975 | Abert | 229/16 R |
| 3,910,483 | 10/1975 | Ritter | 229/32 X |

*Primary Examiner*—Davis T. Moorhead

*Attorney, Agent, or Firm*—Robert H. Eckhoff

[57] ABSTRACT

A box construction is provided which is characterized by having improved end wall construction providing great column strength.

2 Claims, 16 Drawing Figures

BOX CONSTRUCTION

SUMMARY OF THE INVENTION

It is in general the broad object of the present invention to provide an improved corrugated paper box construction in which a pair of side flaps and ends are joined together to provide, in effect, a single member at each end of a box. Such a box has vastly improved strength whereby the boxes can be stacked one upon the other without the lowermost boxes in the stack collapsing.

The improved column strength is secured by joining the side flaps and end panels together by gluing so that, in effect, they become one element at each end of the box. The joining of the several flaps and end panels is preferably achieved by gluing them together. If the panels are joined by rivets, staples, stitching or the like, the improved column strength is not achieved because those joining elements will tear loose and the joined elements will not be effective as a unit to provide increased column strength.

DESCRIPTION OF THE PREFERRED EMBODIEMENTS

Figure 1:
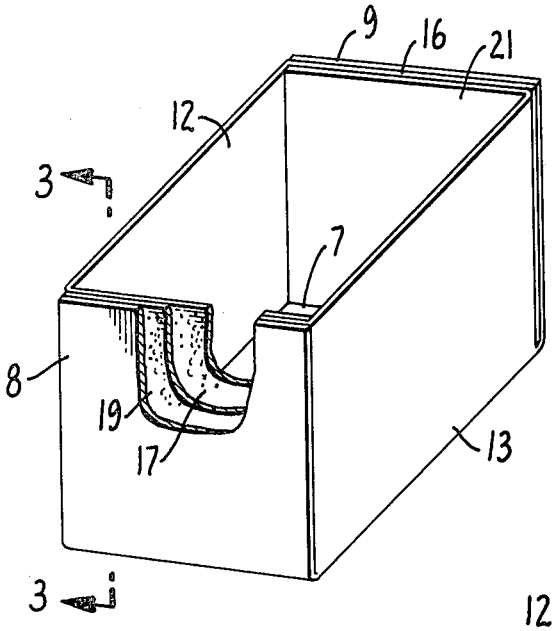
FIG. 1 is a perspective view partly broken away to show the novel end wall construction.
Figure 2:
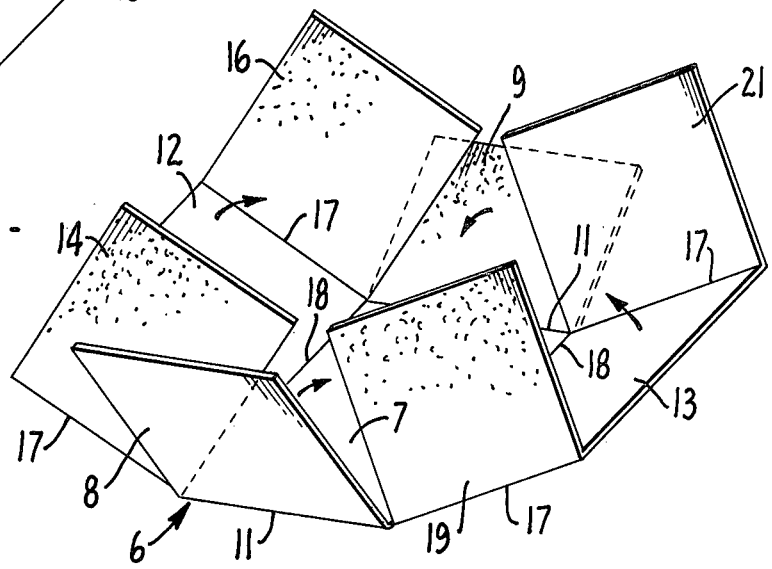
FIG. 2 is a diagrammatic view illustrating how the several box elements are joined together.
Figure 3:
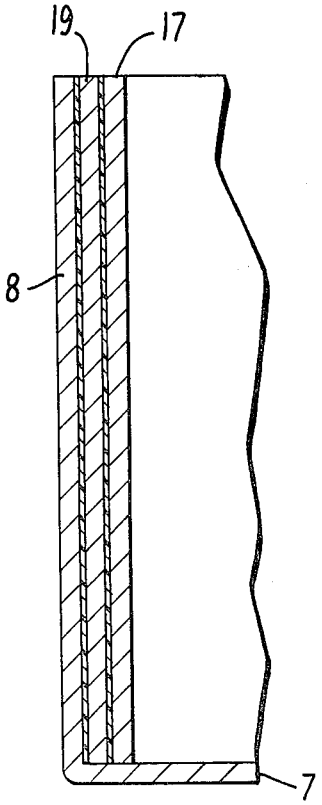
FIG. 3 is a section taken along the lines 3—3 in FIG. 1.
Figure 4:
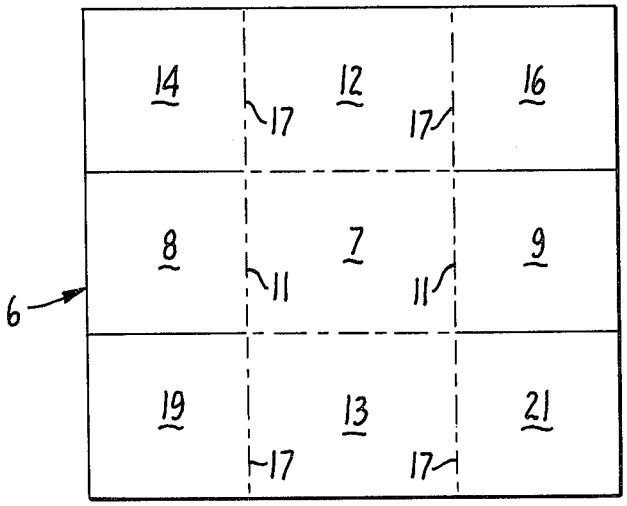
FIG. 4 is a plan view of a blank prior to assembly.

The box blank of FIG. 4, generally indicated at 6, is of corrugated paper and includes a bottom 7 having ends 8 and 9 hinged thereon about fold lines 11. On opposite sides of the bottom 7, I provide side walls 12 and 13, each movable with respect to the bottom 7 about fold lines 18. Side wall 12 has side flaps 14 and 16 thereon movable with respect to the side wall about fold lines 17, while side wall 13 has side flaps 19 and 21 thereon movable with respect to side wall 13 about fold lines 17.

To assemble the box, the side walls 12 and 13 are moved into position at 90° to the bottom and with the side walls extending parallel to one another on opposite sides of the bottom. The side flaps 19 and 21 are then moved about the fold lines 17 until each of the side flaps 19 and 21 extend along the bottom 7 and are normal to the bottom. Side flaps 14 and 16 are then moved about fold lines 17 to extend in a face-to-face abutment with side flaps 19 and 21. The ends 8 and 9 are then moved about hinge lines 11 into a face-to-face engagement with side flaps 14 and 16.

Prior to completion of the folding movement of the several flaps and ends a suitable adhesive such as glue is disposed upon the abutting faces of the side flaps and the ends so that the three elements at each end of the bottom are in a face-to-face engagement and secured together by the glue application.

Figure 5:
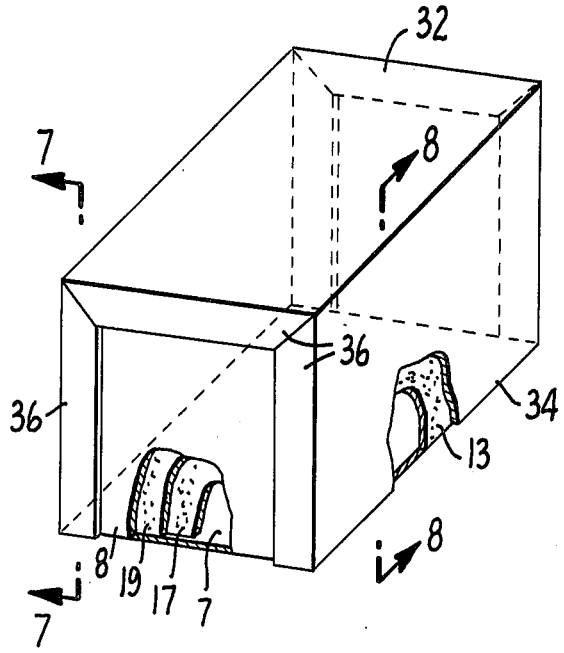
FIG. 5 is a perspective view of the box previously disclosed but with a novel form of top or cover in place.
Figure 6:
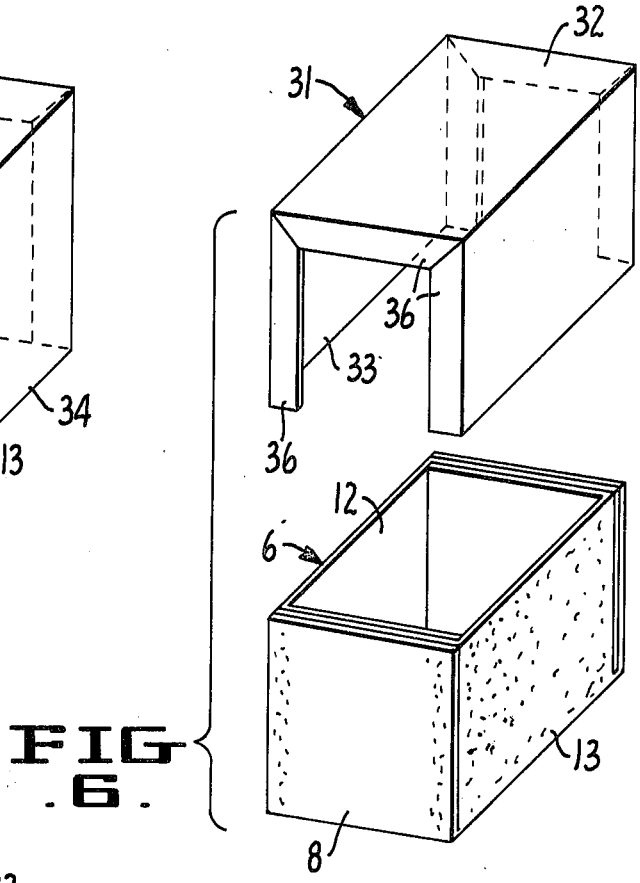
FIG. 6 is a perspective view showing the assembled box top ready for placement as a cover.
Figure 7:
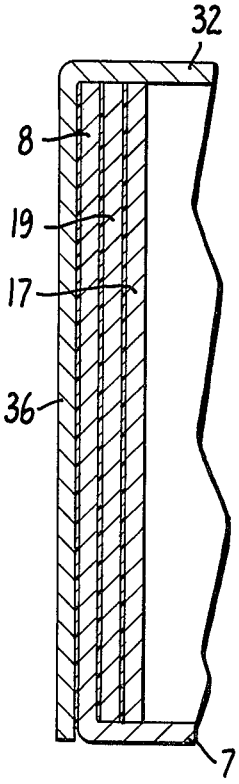
FIG. 7 is a section taken along the line 7—7 in FIG. 5.
Figure 8:
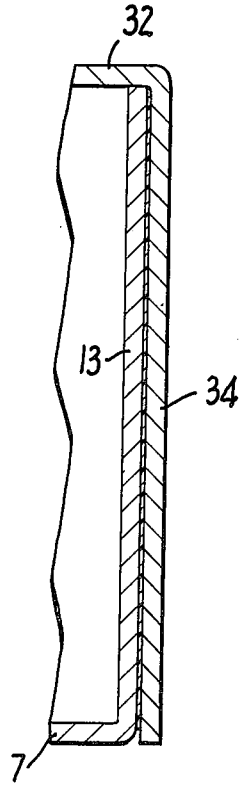
FIG. 8 is a section taken along the line 8—8 in FIG. 5.
Figure 9:
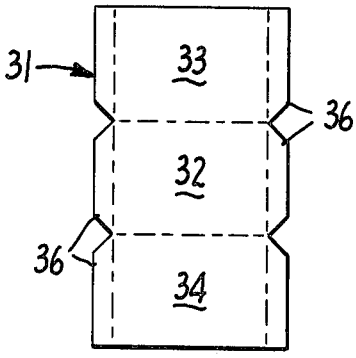
FIG. 9 is a plan view of a blank for forming the top.
Figure 10:
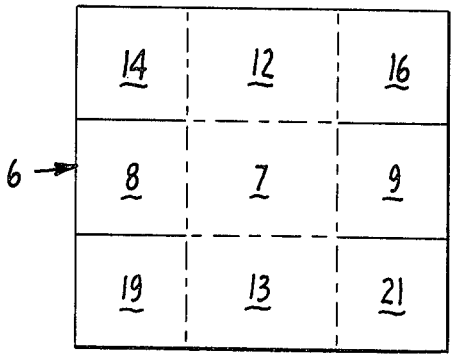
FIG. 10 is a view similar to FIG. 4.
Figure 11:
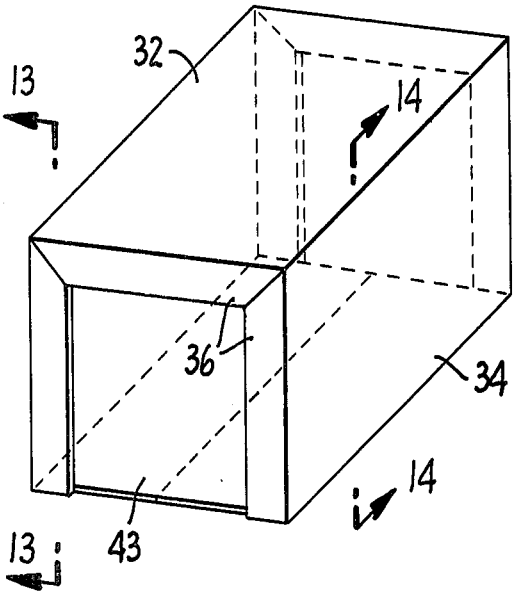
FIG. 11 is a perspective view of the top in position on another form of box.
Figure 12:
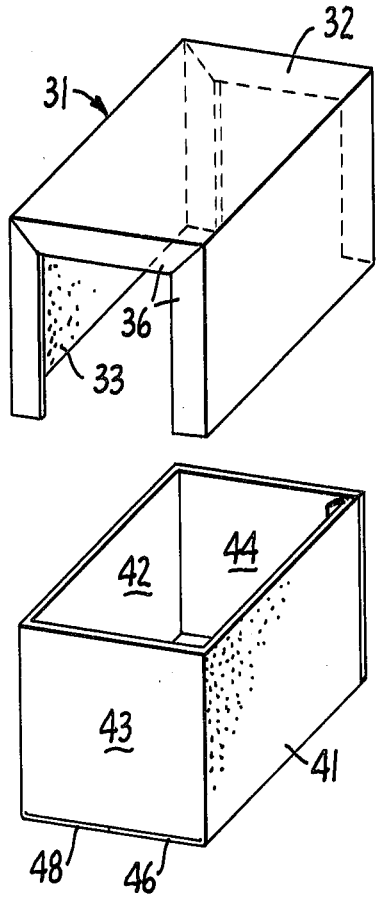
FIG. 12 is a perspective view similar to FIG. 6 showing the top ready for placement over another form of container.
Figure 13:
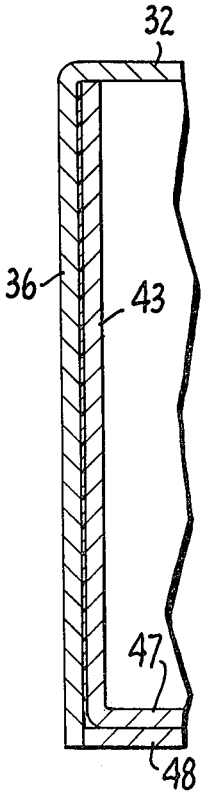
FIG. 13 is a section taken along the line 13—13 in FIG. 11.
Figure 14:
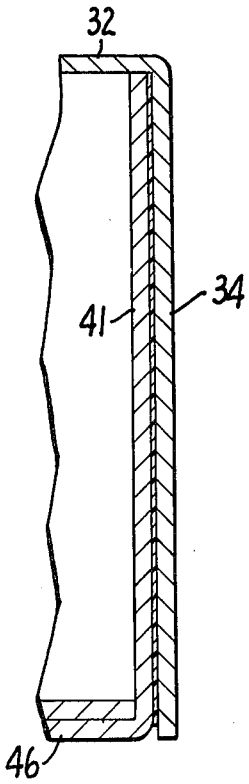
FIG. 14 is a section taken along the line 14—14 in FIG. 11.
Figure 15:
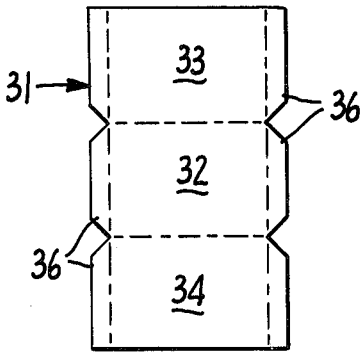
FIG. 15 is a plan view of a form of top cover similar to FIG. 9.
Figure 16:
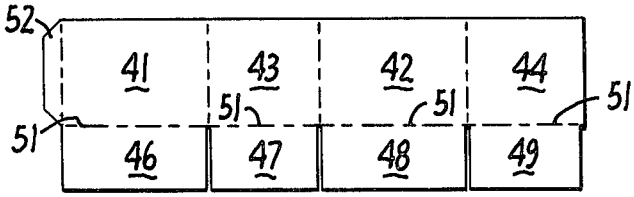
FIG. 16 is a plan view of a box form for forming the box shown in FIG. 12.

Referring to FIGS. 5–10 and particularly to FIG. 9, the top generally indicated at 31 includes a cover panel 32 and side panels 33 and 34. Each of the panels 32, 33 and 34 has side flaps 36. Each of the side flaps and the side elements 33 and 34 have glue applied to the inner surfaces so that when the cover is positioned over the box and the two are assembled, as is shown in FIGS. 5 and 6, the flaps 36 and the side panels 33 and 34 are joined to the abutting surfaces of the box. The panels 33 and 34 increase the side strength of the corresponding side panels of the box.

In that form of the invention shown in FIGS. 11–16, a lower box is formed from a continuous sheet of corrugated board having side panels 41 and 42 and end panels 43 and 44, each of these panels having panels 46 through 49 joined thereto and movable with respect to the side panels 41–44 along the fold lines 51. Panels 46–49 are movable with respect to their attached panels to provide a bottom portion. Tab 52 is secured to the opposite side of panel 41 to provide a completed closure as is shown in the lower portion of FIG. 12. The lower box is assembled into the form shown in the lower portion of FIG. 12. In use, once the lower box has been filled with a product, the top cover is then completed and fitted over the box, side tabs 36 being secured to the corresponding surfaces on the lower box while panels 33 and 34 are secured to the abutting panels on the lower box.

I claim:

1. A box construction comprising:

a lower element including a rectangular bottom panel, a pair of rectangular end panels each connected to an end edge of said bottom panel by a foldline, a pair of rectangular side wall panels each connected to an end edge of said bottom panel by a foldline, each of said end and side wall panels extending for essentially the entire length of the bottom panel end edge to which it is attached, a plurality of rectangular end flaps each connected to a side wall panel end edge by a foldline, said end flaps having a size essentially equal to the size of said end panels, each of said end flaps overlapping each other and covering an associated end panel so that each end panel has a pair of end flaps completely covering same thereby forming a container having triple-ply end walls and single ply side walls;

first adhesive means interposed between each of said overlapping end flaps and between said overlapping end flaps and said associated end panel;

a containment element having a rectangular cover panel, a pair of rectangular side panels each connected to a side edge of said cover panel by a foldline, and a plurality of trapezoidal side flaps each connected to an end edge of one said cover and side panels by foldlines, each of said side panels having a size essentially equal to the size of each of said side wall panels to completely cover said each side wall panel, said side flaps bordering said end panels on three edges thereof; and second adhesive means on said side wall panels for attaching each of said containment element side panels to an associated one of said side wall panels so that said each side wall panel essentially completely covers said associated side wall panels; and third adhesive means on said end panels for attaching each of said containment element side flaps to an associated one of said end panels for sealingly closing the box.

2. A box construction comprising:

a lower portion including a pair of rectangular side wall panels and a pair of rectangular end panels, said side wall and end panels being connected together at end edges thereof in an alternating arrangement whereby one of said end panels has side wall panels connected thereto at both end edges thereof and one of said side wall panels has end panels connected thereto at both end edges thereof, a first pair of rectangular bottom panels each connected along a side edge thereof by a foldline to a side edge of one of said side wall panels, a second pair of rectangular bottom panels each connected along a side edge thereof by a foldline to a side edge of one of said end panels, and a trapezoidal tab connected by a foldline to an end edge of another one of said side wall panels, the panels of said first pair of bottom panels contacting each other along another side edge thereof and the panels of said second pair of bottom panels contacting each other along another side edge thereof and overlapping the panels of said first pair of bottom panels to form a double ply bottom for said lower portion, first adhesive means on said side wall panels, second adhesive means on one of said end panels securing said tab to said one end panel;

a containment element having a rectangular cover panel, a pair of rectangular side panels each connected to a side edge of said cover panel by a foldline, and a plurality of trapezoidal side flaps each connected to an end edge of one said cover and side panles by foldlines, each of said side panels having a size essentially equal to the size of each of said side wall panels to completely cover said each side wall panel, said side flaps bordering said end panels on three edges thereof; and second adhesive means on said end panels for attaching each of said containment element side flaps to an associated one of said end panels for sealingly closing the box.

* * * * *